US006979180B2

(12) United States Patent
Motherwell

(10) Patent No.: US 6,979,180 B2
(45) Date of Patent: Dec. 27, 2005

(54) HOLLOW COMPONENT WITH INTERNAL DAMPING

(75) Inventor: Andrew Motherwell, Bristol (GB)

(73) Assignee: Rolls-Royce PLC, London (GB)

( * ) Notice: Subject to any disclaimer, the term of this patent is extended or adjusted under 35 U.S.C. 154(b) by 64 days.

(21) Appl. No.: 10/769,859

(22) Filed: Feb. 3, 2004

(65) Prior Publication Data

US 2004/0191069 A1 Sep. 30, 2004

(30) Foreign Application Priority Data

Mar. 29, 2003 (GB) ..... 0307365

(51) Int. Cl.[7] ..... F01D 5/18
(52) U.S. Cl. ..... 416/229 R; 416/232; 416/233; 416/241 R; 416/500
(58) Field of Search ..... 416/229 R, 232, 416/233, 241 R, 241 B, 500, 223 R

(56) References Cited

U.S. PATENT DOCUMENTS 3,758,233 A * 9/1973 Cross et al. ..... 416/229 R
6,039,542 A * 3/2000 Schilling et al. ..... 416/233
6,669,447 B2 * 12/2003 Norris et al. ..... 416/224
2002/0122718 A1 9/2002 Motherwell et al.
2003/0217791 A1 11/2003 Bamberg et al.

FOREIGN PATENT DOCUMENTS

| | | |
|---|---|---|
| EP | 1 247 941 A1 | 10/2002 |
| GB | 2 390 402 A | 1/2004 |
| GB | 2 395 204 A | 5/2004 |
| WO | WO 99/23278 | 5/1999 |

* cited by examiner

*Primary Examiner*—Edward K. Look
*Assistant Examiner*—Dwayne J White
(74) *Attorney, Agent, or Firm*—Oliff & Berridge, PLC

(57) ABSTRACT

A component, for example a fan blade for a gas turbine engine, comprises panels 2 and 4 which define between them a cavity containing a warren girder structure 6. Internal surfaces of the panels 2 and 4 are provided with a damping material 14, disposed between regions of contact 12 between the warren girder 6 and the panels 2, 4. The damping material damps vibrations of the component, so extending its fatigue life.

25 Claims, 1 Drawing Sheet

Figures 1, 2:
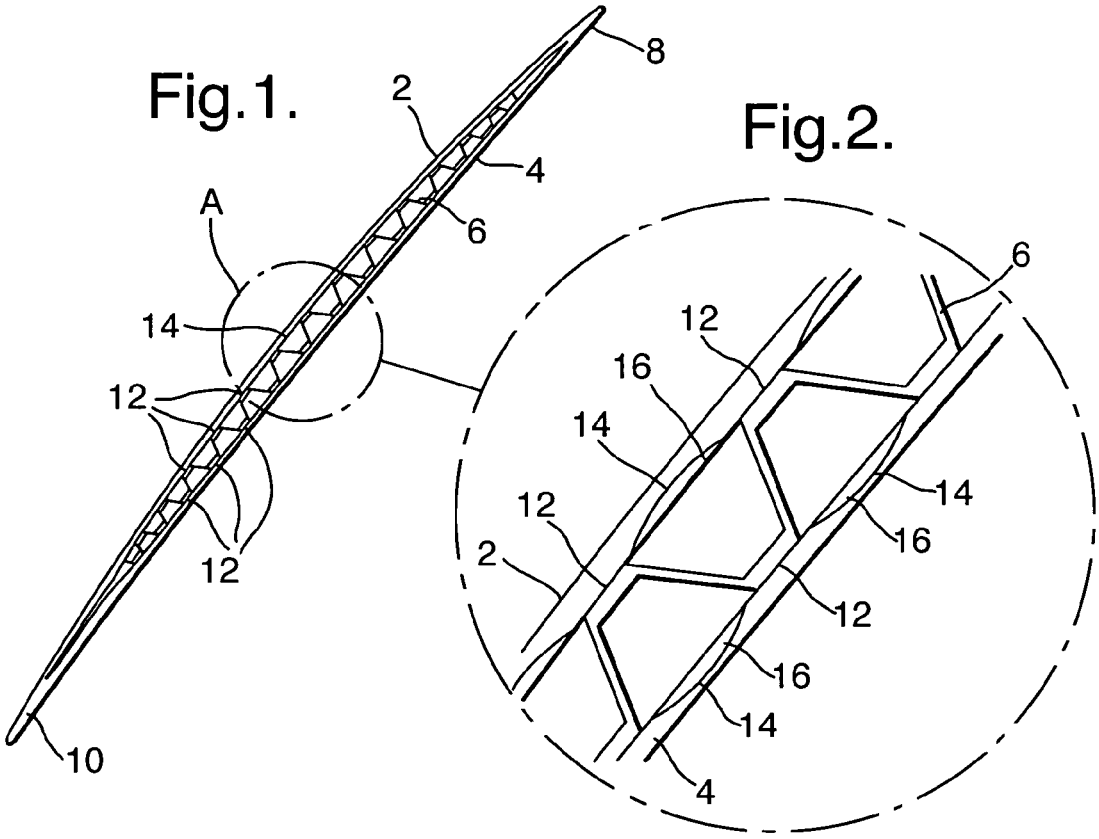

8
2
4
6
A
14
12
12
10
6
12
16
14
12
2
14
16
12
16
14
4

HOLLOW COMPONENT WITH INTERNAL DAMPING

This invention relates to a hollow component with internal damping, and a method of manufacturing such a component. The invention is particularly, although not exclusively, concerned with components for use in gas turbine engines, for example fan blades.

Blades of gas turbine engines are subject to vibration induced by flutter and distortions in the gas flow over the blades. It is known to damp such vibrations by coating the outer surface of the blade with a suitable damping material, for example as disclosed in U.S. Pat. No. 3,758,233. That document discloses a fan blade coated with a ceramic material, such as magnesium aluminate ($MgO.Al_2O_3$). A problem with such coatings is that they impose constraints on the surface finish obtainable on the aerodynamic surfaces of the blade. Furthermore, such coatings tend to be vulnerable both to erosion and foreign object damage (FOD) with the result that the aerodynamic performance of the blades, and their response to vibration, can be degraded.

Conventionally, rotors of gas turbine engines are assembled from a rotor disc and a plurality of blades which are secured to the periphery of the disc. The means of attachment between the blades and the disc, for example a fir-tree root arrangement, frequently provide some frictional damping which reduces the amplitude of any vibrations and so increases the resistance of the components to high cycle fatigue failure. It is becoming more common for blades and discs to be welded together to form unitary bladed discs, or blisks. Blisks have no mechanical joint at the roots of the blades, and so the damping effect achieved at such joints is absent. There is consequently an increased need for alternative damping means to be provided in blisks.

A further development in blade manufacture is disclosed in EP 0568201, and comprises the manufacture of blades, such as fan blades, by a superplastic forming and diffusion bonding technique which results in a hollow blade, ie a blade having at least one internal cavity. In the technique disclosed in EP 0568201, at least two sheets are laid in face-to-face contact with a predetermined pattern of stop-off material applied to one of the sheets. The sheets are diffusion bonded together, except where this is prevented by the stop-material. Subsequently, internal pressure is created between the sheets, causing them to deform superplastically to form cavities in the regions where diffusion bonding was prevented by the stop-off material. This technique can be used to manufacture hollow fan blades which can be welded to a disc to form a blisk.

According to one aspect of the present invention, there is provided a method of manufacturing a hollow component for a gas turbine engine, in which method a coating of a damping material is provided on an internal surface of the component.

In the context of this invention "damping material" means a material which dissipates strain energy, for example as heat, to a significant extent, by which is meant an extent greater than the energy dissipation of the principal material from which the component is formed. This principal material may form the substrate to which the damping material is applied. Visco elastic materials may be suitable damping materials, but in preferred embodiments in accordance with the invention, a ceramic or other refractory material is used as the damping material.

In a specific embodiment in accordance with the present invention, the component is a component for a gas turbine engine, for example a rotor blade such as a fan blade. Such a component is commonly manufactured principally from a metallic material, for example a titanium alloy. In such components, the damping material may comprise a spinel such as magnesia alumina spinel.

The component, particularly if it is a fan blade for a gas turbine engine, may be manufactured in accordance with a method as disclosed in EP 0568201. In a preferred method, the component is assembled from two outer panels and an intermediate membrane which are clamped together under pressure so that the components form diffusion bonds between one another, except at locations where stop-off material has been applied. The resulting structure is then heated and internally pressurised to move the outer panels apart from one another, causing the intermediate sheet to form a warren girder internal structure.

In accordance with a preferred embodiment, the damping material is applied to at least one region of the internal face (with respect to the finished component) at which diffusion bonding between that outer panel and the intermediate sheet is to be prevented. Thus, the damping material may be applied as a series of stripes on the inner face of each outer panel, a stop-off material then being applied over the damping material before the panels and the intermediate sheet are stacked together for diffusion bonding. If the component is a blade of a gas turbine engine, the stripes may extend in the lengthwise direction of the blade.

The damping material may be applied in a recess formed in the substrate material of the component, so that the surface of the damping material is slightly underflush with the surrounding surface of the substrate material.

According to another aspect of the present invention, there is provided a hollow component for a gas turbine engine of which an internal surface is provided with a coating of a damping material.

The present invention also provides a blisk and a process for manufacturing a blisk.

For a better understanding of the present invention, and to show more clearly how it may be carried into effect, reference will now be made, by way of example, to the accompanying drawings, in which:—

FIG. 1 is a sectional view taken through a fan blade of a gas turbine engine; and FIG. 2 is an enlarged view of the region A in FIG. 1.

The fan blade shown in FIG. 1 comprises outer panels 2,4 between which a warren girder structure 6 is disposed. The panels 2, 4 and the warren girder structure 6 are made from a titanium alloy. The panels 2 and 4 are diffusion bonded to each other at the leading and trailing edges 8, 10 of the blade, and to the warren girder structure 6 at contact regions 12, so that the warren girder structure 6 provides a plurality of partitions extending across the interior of the blade.

At positions between the contact regions 12, the inner surfaces of the panels 2 and 4 are provided with a coating 14 of a damping material such as magnesia alumina spinel.

The coatings 14 fill (or almost fill) recesses 16 formed in the inner faces of the panels 2 and 4. These recesses 16 are in the form of grooves which extend longitudinally along the length of the blade, so that the coatings 14 are applied as stripes on these inner faces.

The blade shown in FIGS. 1 and 2 is formed from precursors of the panels 2 and 4 and the warren girder structure 6. These precursors are initially flat. The elongate recesses 16 are formed in those faces of the precursors of the panels 2 and 4 which will be on the inside of the finished blade. Damping material is then applied in the recesses 16 and built up to finish slightly below the level of the substrate surface adjacent the recesses 16. The damping material, for example magnesia alumina spinel, may be applied by any suitable process, but preferably a plasma spray technique is used in which the damping material, in powder form, is entrained in a very high temperature plasma flame, where it is rapidly heated to a molten or softened state and accelerated to a high velocity. The hot material passes through a nozzle and impacts on the substrate surface, where it rapidly cools, forming the coating 14.

A stop-off material, for example yttria, is then applied over the damping material to completely cover the coating. The stop-off layer may, for example be applied by a silk screen printing process.

It will be appreciated from FIG. 2 that the coatings 14 on the panels 2 and 4 (and consequently on their precursors) are offset with respect to each other, so that the spaces between the coating stripes 14 on one of the panels are disposed opposite the coating stripes 14 on the other panel. The spacing between adjacent stripes is narrower than the stripes themselves, with the result that the oppositely facing coating stripes 14 slightly overlap one another.

The flat precursors of the panels 2 and 4, with the coatings 14 and the yttria stop-off layers are then assembled face-to-face with the precursor of the warren girder structure 6, in the form of a flat membrane, between them. The precursors are pressed together at high pressure and temperature so that diffusion bonds are created between contacting metal-to-metal regions corresponding to the contact regions 12 in FIG. 2. The yttria stop-off layer prevents full bonding between the coatings 14 and the membrane corresponding to the structure 6.

When bonding has been achieved, the assembly is heated to a temperature at which the assembly can be hot formed into a desired configuration in which, for example, the assembly has an arcuate cross-section with a twist between the ends of the assembly, approximating to a desired blade profile.

Subsequently, the assembly is heated to a temperature at which superplastic deformation of the elements of the assembly can occur, and the assembly is internally pressurised. This forces the panels 2 and 4 apart from each other between their leading and trailing edges. Since the membrane which forms the warren girder structure 6 is diffusion bonded at staggered intervals to the panels 2 and 4, but not bonded (or at least not strongly bonded) where the yttria stop-off layer is present, the membrane will superplastically deform into the configuration shown in FIGS. 1 and 2. The resulting structure is consequently that of a hollow component having coatings of damping material 14 on the internal surfaces of the panels 2 and 4. The component therefore exhibits a reduction in the amplitude of vibration when subjected to excitation, for example by flow conditions around the blade. The reduced amplitude of vibration thus reduces the tendency of the blades to fail under high cycle fatigue conditions.

Furthermore, since the damping material is on the inner surfaces of the panels 2 and 4, it is not exposed to gas flow over the blade, nor to foreign objects striking the blade.

Consequently, the abrasive material 14 has a reduced tendency to erode or be damaged. Furthermore, the outer surface finish of the panels 2 and 4 is not influenced by the presence of damping material and so can be optimised to provide the desired aerodynamic characteristics of the blade.

What is claimed is:

1. A method of manufacturing a hollow component for a gas turbine engine, in which the component is manufactured from a plurality of panels that are joined together to define a component with an internal cavity, wherein damping material is applied to at least one of the panels before the panels are joined together so that a coating of the damping material is provided on at least part of the surface of the interior cavity.

2. A method as claimed in claim 1, in which the panels are joined together in a diffusion bonding process.

3. A method as claimed in claim 2, in which the component comprises two of the said panels, the method comprising:

(a) joining the panels together at adjacent edge regions in the diffusion bonding process;

(b) deforming the panels by applying internal pressure between the panels, thereby to create an internal cavity.

4. A method as claimed in claim 3, in which step (b) comprises heating the panels and deforming them superplastically.

5. A method as claimed in claim 3, in which an intermediate membrane is disposed between the panels, the membrane being bonded in the diffusion bonding process to each of the panels at spaced locations, the damping material being situated outside the spaced locations, whereby deformation of the panels under the internal pressure causes the membrane to form partitions extending between the panels across the internal cavity.

6. A method as claimed in claim 5, in which a stop-off material is applied to the damping coating to prevent or minimise diffusion bonding between the membrane and the damping coating.

7. A method as claimed in claim 6, in which the stop-off material comprises yttria.

8. A method as claimed in claim 5, in which the damping material is applied to the panels in a striped pattern, the spaces between adjacent stripes on one of the panels being disposed opposite a stripe on the other panel, whereby the membrane forms a warren girder structure within the component.

9. A method as claimed in claim 1, in which the damping material is applied within a recess of a substrate that defines the internal cavity of the component.

10. A method as claimed in claim 9, in which the damping material is applied within the recess to form a damping material surface which lies below the surrounding surface of the substrate.

11. A method as claimed in claim 1, in which the damping material is applied by a plasma spraying process.

12. A method as claimed in claim 1, in which the component is a fan blade of a gas turbine engine.

13. A process for manufacturing a blisk, the process comprising manufacturing a plurality of fan blades, by a method in accordance with claim 1, and subsequently welding the fan blades to a disc.

14. A hollow component for a gas turbine engine, the hollow component comprising an outer wall defining an internal cavity and a layer of damping material provided on at least part of the surface of the internal cavity, wherein the damping material is situated in a recess in a substrate that defines the internal cavity and the damping material extends part way across the cavity.

15. A hollow component as claimed in claim 14, in which the damping material is a ceramic material.

16. A hollow component as claimed in claim 15, in which the damping material is a spinel.

17. A hollow component as claimed in claim 16, in which the damping material is magnesia alumina spinel.

18. A hollow component as claimed in claim 14, in which the surface of the damping material lies beneath the surrounding surface of the substrate material.

19. A hollow component for a gas turbine engine, the hollow component comprising an outer wall defining an internal cavity and a layer of damping material provided on at least part of the surface of the internal cavity, wherein a partition structure is disposed within the interior of the component, and contacting the outer wall at spaced contact regions, the damping material being applied to the internal surface of the outer wall at regions between the contact regions and extending part way across the cavity.

20. A hollow component as claimed in claim 19, in which the partition structure comprises a warren girder structure, the contact regions comprising parallel, elongate regions.

21. A hollow component as claimed in claim 19, in which the outer wall comprises two panels which are bonded together at opposite edges.

22. A hollow component as claimed in claim 14, in which the damping material is applied to a substrate of titanium alloy.

23. A hollow component as claimed in claim 14, which comprises a fan blade.

24. A hollow component as claimed in claim 19, in which the damping material is a ceramic material.

25. A hollow component as claimed in claim 19, in which the damping material is magnesia alumina spinel.

* * * * *